US007086237B2

(12) United States Patent
Arshansky et al.

(10) Patent No.: US 7,086,237 B2
(45) Date of Patent: Aug. 8, 2006

(54) METHOD AND APPARATUS TO MEASURE AND TRANSFER LIQUEFIED REFRIGERANT IN A REFRIGERATION SYSTEM

(76) Inventors: Yakov Arshansky, 5262 E. Shore Dr., SW, Conyers, GA (US) 30094; Paul Thomas Wickberg, 2900 Thomas Ave., S., Apt. 2431, Minneapolis, MN (US) 55416; Daniel Thomas Johnson, 2505 Willow Dr., Medina, MN (US) 55340

( * ) Notice: Subject to any disclaimer, the term of this patent is extended or adjusted under 35 U.S.C. 154(b) by 0 days.

(21) Appl. No.: 10/853,995

(22) Filed: May 6, 2004

(65) Prior Publication Data

US 2005/0247070 A1 Nov. 10, 2005

(51) Int. Cl.
*F25B 45/00* (2006.01)

(52) U.S. Cl. ..... 62/77; 62/149; 62/292

(58) Field of Classification Search ..... 62/77, 62/126, 149, 292, 434; 137/205; 417/118
See application file for complete search history.

(56) References Cited

U.S. PATENT DOCUMENTS

| | | | | |
|---|---|---|---|---|
| 4,363,222 | A * | 12/1982 | Cain | 62/292 |
| 5,097,667 | A | 3/1992 | Gramkow | 62/77 |
| 5,195,333 | A * | 3/1993 | Van Steenburgh, Jr. | 62/292 |
| 5,201,188 | A * | 4/1993 | Sakuma | 62/149 |
| 5,247,802 | A * | 9/1993 | Maniez et al. | 62/77 |
| 5,363,665 | A * | 11/1994 | Sundman | 62/125 |
| 5,560,215 | A * | 10/1996 | Talarico | 62/149 |
| 5,782,100 | A * | 7/1998 | Wilson | 62/149 |
| 6,141,977 | A * | 11/2000 | Zugibe | 62/149 |
| 6,202,433 | B1 * | 3/2001 | Murray et al. | 62/292 |
| 6,247,325 | B1 * | 6/2001 | Muston et al. | 62/292 |
| 6,314,749 | B1 * | 11/2001 | Van Steenburgh, Jr. | 62/292 |
| 6,408,637 | B1 * | 6/2002 | Hanson et al. | 62/292 |
| 6,434,953 | B1 | 8/2002 | Bimboes et al. | 62/77 |
| 6,609,381 | B1 | 8/2003 | Morgan | 62/50.1 |
| 2003/0110785 | A1 | 6/2003 | Williamson et al. | 62/149 |

FOREIGN PATENT DOCUMENTS

| | | | |
|---|---|---|---|
| GB | 0802400 | A1 * | 10/1997 |
| JP | 4-169766 | A * | 6/1992 |

* cited by examiner

*Primary Examiner*—Mohammad M. Ali
(74) *Attorney, Agent, or Firm*—Thomas, Kayden, Horstemeyer & Risley, LLP

(57) ABSTRACT

A method, system and apparatus for transferring a measured level of liquefied refrigerant to a refrigeration system includes the steps of purging a calibration container; filling the calibration container with liquefied refrigerant from a liquefied refrigerant supply to a desired level; and charging a system with the liquefied refrigerant from the calibration container.

23 Claims, 7 Drawing Sheets

METHOD AND APPARATUS TO MEASURE AND TRANSFER LIQUEFIED REFRIGERANT IN A REFRIGERATION SYSTEM

FIELD OF THE INVENTION

This invention concerns the replacement of liquefied refrigerant in refrigeration systems. A measured amount of refrigerant fluid is charged into the refrigeration system.

BACKGROUND OF THE INVENTION

Refrigeration fluids, commonly known as refrigerants, are the media used for heat transfer in a refrigeration system to absorb heat when the fluid is at a low temperature and low pressure and to give up heat when the fluid is at a high temperature and a high pressure. This involves changes of state of the refrigerant. The common refrigerants for commercial refrigeration system include R-22, R-404a, R-507, R-410, R-407, R-134a, among others and are widely used. Natural gas (consisting of 95% methane, such as R-50) and propane (R-290) are also typical refrigerants along with others belonging to the propane and methane series. At present time, a natural refrigerant such as carbon dioxide (R-744) is becoming popular. On the other hand, all refrigerants are typically liquefied gases that, in the process of evaporation, produce refrigeration effects utilized for numerous applications.

Commercial refrigeration and HVAC systems typically use refrigerants to deliver cooling for a variety of applications. These applications include refrigerated cases, freezers, and air conditioning systems, as well as many other types of systems. These refrigeration systems are "closed loop systems." A closed loop system is defined as a system that contains a defined amount of refrigerant that circulates through evaporation and condensing stages to alternately cool through the evaporation process and through off heat through the condensing process.

Closed loop refrigeration systems operate at optimum efficiency when they have a quantity of refrigerant that facilitates the refrigeration process. This quantity of refrigerant is typically referred to as a "full charge." The design of the system, its size and components are factors that determine the appropriate full charge. For example, a typical supermarket may have as much as 3,000 to 5,000 pounds of refrigerant in its refrigeration and air conditioning systems. When a new system is built, it is important to determine and document the initial full charge of refrigerant required to enable the system to operate at its optimum designed level of efficiency. This is the "initial full charge."

Once a closed loop system has received its initial full charge, the system typically experiences changes in the level of refrigerant. These changes in refrigerant level can be caused by a broad range of factors. Changes in temperature can change the density of the refrigerant which can require the addition or removal of refrigerant to maintain the optimum operation of the system. The servicing or replacement of components may require the controlled removal of refrigerant from the system to facilitate the component replacement. In addition, leaks can develop in the components of the system or in pipes connecting the components from a broad range of causes. Statistically, the average loss in these systems can approach thirty to forty percent each year.

Often, low levels of refrigerant are not easily identifiable. For example, in a supermarket, there may be complaints about a temperature problem, such as the ice cream in its refrigerated case getting soft. What may be occurring is what is generally called "starving the system": there is not enough liquid refrigerant in the system. The source of the leak is investigated and repaired. Then it is necessary to recharge the system with an appropriate amount of refrigerant to achieve a full charge.

U.S. Pat. No. 5,097,667 to Gramkow demonstrates a typical method of recharging a refrigeration system. However, it does not measure the amount transferred.

Current regulations, namely section 608 of the Clean Air Act, require service practices that maximize the recycling of ozone depleting compounds (refrigerants) during the servicing and disposal of air conditioning and refrigeration equipment. The regulations allow the addition of refrigerant to a depleted refrigeration system, but the regulations set restrictions on the amount of refrigerant that may leak from the system.

Owners of equipment with charges of refrigerant greater than fifty pounds are required to repair leaks in the equipment when those leaks would result in the loss of more than a certain percentage of the refrigerant charge of the equipment over a continuous one year period. For the commercial and industrial process refrigeration sectors, including supermarkets, refrigerated warehouses, and other large refrigerated facilities, refrigerant leaks must be repaired such that the appliance would not exceed a calculated leak rate of 35% for a period of greater than 30 days per the guidelines of the Environmental Protection Agency (EPA) in the United States. For all other sectors, including comfort cooling, leaks must be repaired such that the calculated leak rate does not exceed 15% for a period greater than 30 days. The calculation for replacement rate is the projected leak rate over the next year based on the most current replacement rate rather than the total quantity of refrigerant lost, although this may be taken into consideration in the event of a government audit.

For instance, owners of a commercial refrigeration system containing one hundred pounds of charge must repair leaks if they find that the system has lost ten pounds of charge over the past month. Although ten pounds represents only ten percent of the system charge in this case, a leak rate of ten pounds per month would result in the release of over 100% of the charge over the year.

To track leak rates, owners of air conditioning and refrigeration equipment with more than fifty pounds of charge must keep records of the quantity of refrigerant added to their equipment during servicing and maintenance procedures, as well as the type of repair and method of leak testing. Owners are required to repair leaks within thirty days of discovery if the leaks would result in a calculated rate greater than the required limit. This requirement is waived if, within thirty days of discovery, the owner develops a one year retrofit or retirement plan for the leaking equipment. An owner of industrial process refrigeration equipment may qualify for additional time under certain circumstances and may have other unique requirements for leak repair verification.

In a typical commercial or industrial refrigeration system there may be 2,000 or more fittings connecting system components, and a leak can occur in any of them. Therefore, there is a great potential for leakage and enormous financial consequences.

The typical method technicians use to measure refrigerant today is to weigh their supply tank on a scale before and after transfer of refrigerant from the supply tank to the refrigeration systems. Another method known in the art is a system based upon a digital scale. U.S. Pat. No. 6,609,381 to Morgan demonstrates the digital scale method. The container is placed on a digital scale platform and the scale records the beginning weight and the ending weight. The amount used can be calculated manually or displayed on the scale's user interface.

These methods are inconvenient and prone to error and malfunction due to the mechanical strain on the scales, repeated use, or external influence which might bias the resulting calculation. In addition, in many cases, technicians may simply estimate the amount of refrigerant based on how heavy the container "feels", which, if inaccurate, can impact the cost of the service call and/or bias the EPA rate calculation.

SUMMARY OF THE INVENTION

It is to these problems that the invention is directed. An embodiment of this system will be able to measure how much refrigerant is added or removed during a service event, thus enabling close monitoring capabilities for financial and regulatory reasons. Another embodiment will further enable electronic monitoring, logging, and communication to a record-keeping system which may be on-line.

This invention includes equipment that meters the refrigerant charged from a supply into a refrigeration system, without the use of a scale or estimation as it goes into the refrigeration system would be useful and facilitate compliance with the environmental regulations. Additionally, this invention provides an improved method for communicating the result of such addition or subtraction of refrigerant to an automated record-keeping and alerting system.

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views

BRIEF DESCRIPTION OF THE DRAWINGS

FIG. 3 is a diagram of the system in FIG. 2. with a self-contained subcooler.

DETAILED DESCRIPTION OF THE INVENTION

Figure 2:
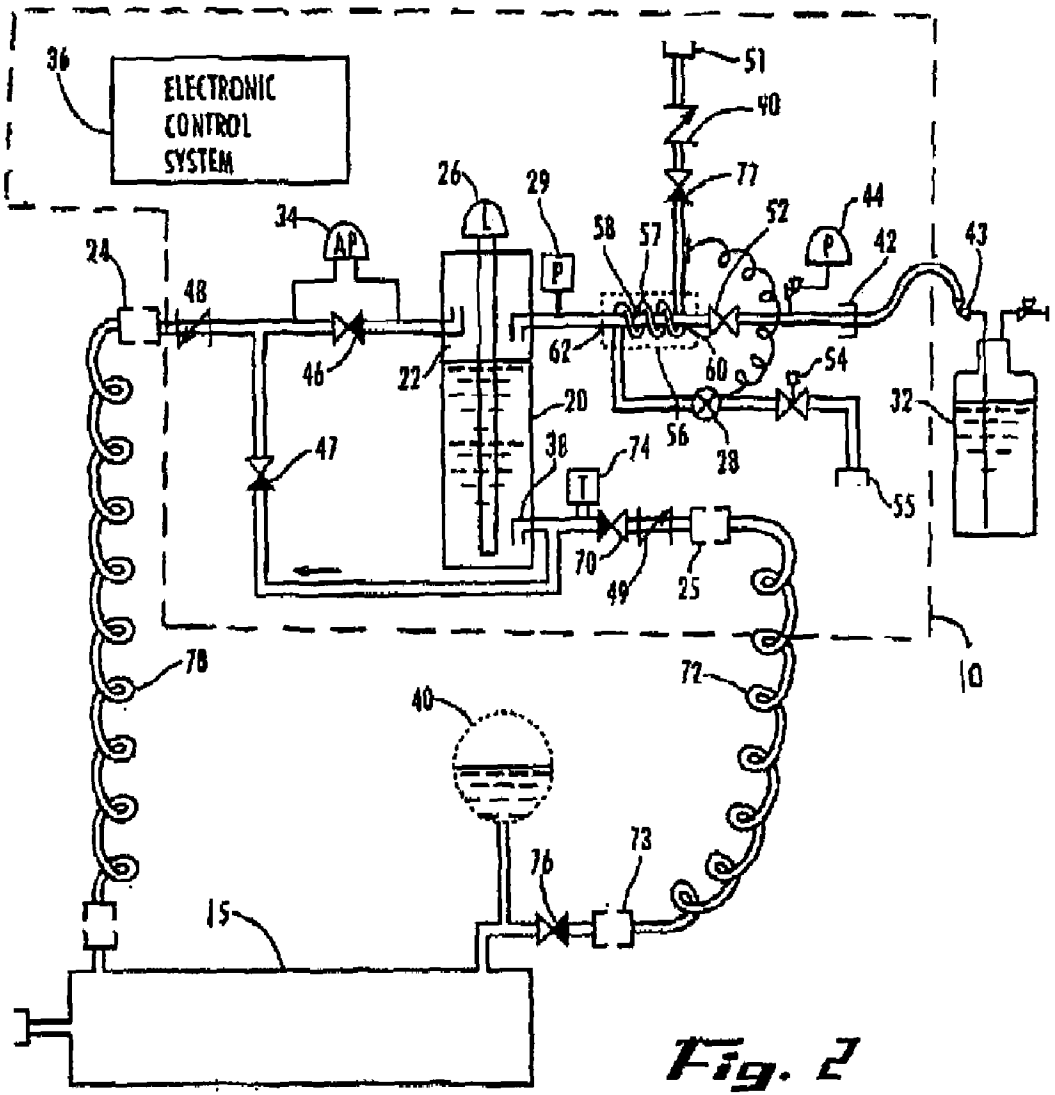
FIG. 2 is a diagram of a system for measuring the amount of refrigerant added to a system.

Referring now to the drawings in detail, in the preferred embodiment, FIG. 2 illustrates the apparatus 10 for measuring and transferring liquefied refrigerant to a refrigeration system 15 of the type used to refrigerate large spaces such as freezers and refrigerated cabinets in supermarkets and refrigerated warehouses, etc. As shown in FIG. 2, each switch/relay/solenoid that controls the flow of refrigerant is electromechanical and is electrically connected to an electronic control system 36. Additionally, all pressure switches, transducers, level measurement transmitters, and any other controllable element may be connected to and controlled by the electronic control system 36. Connections to the electronic control system 36 are not shown in the drawings.

Figure 1:
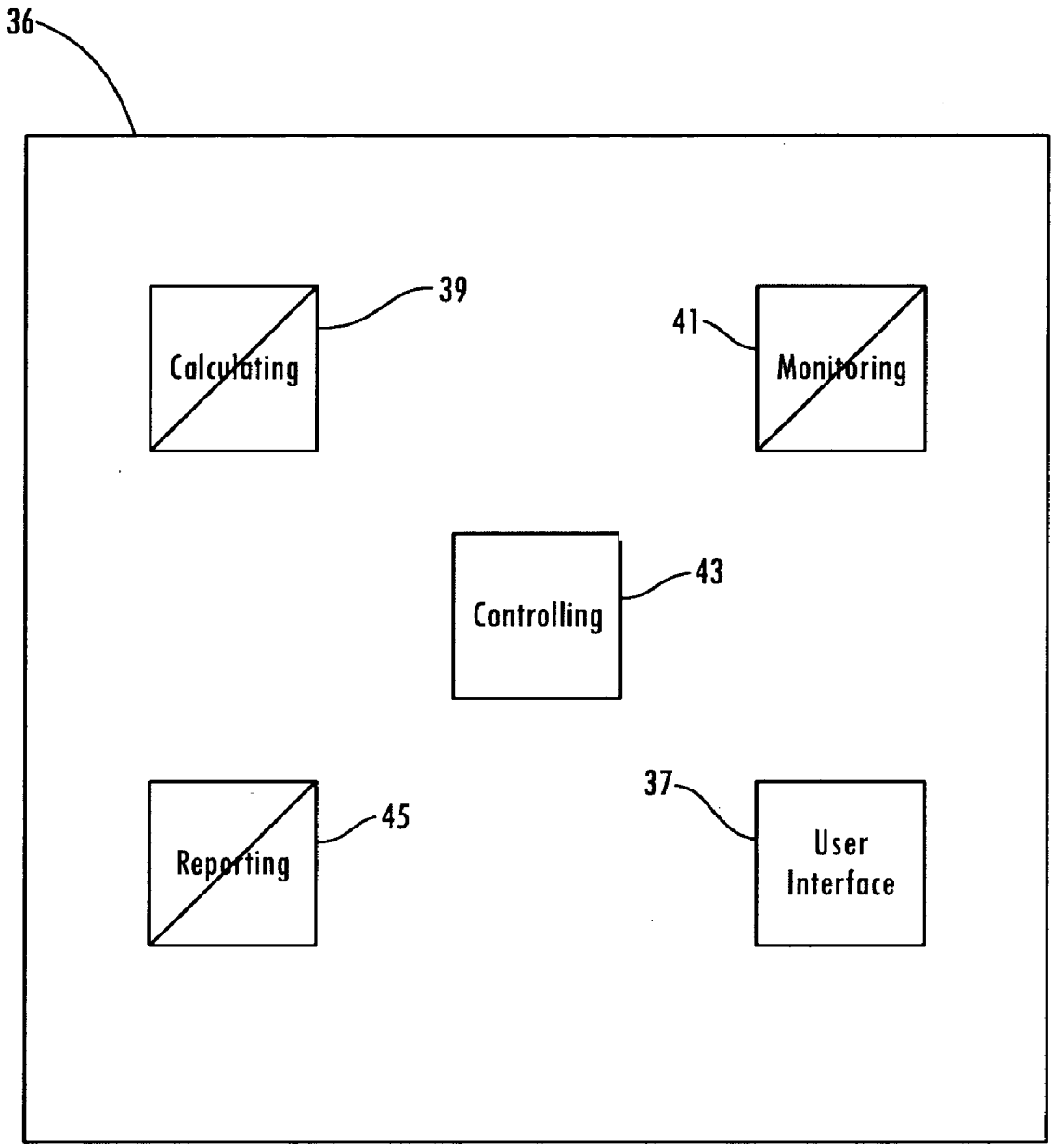
FIG. 1 is a block diagram of an electronic control system 36.

Referring to FIG. 1, the electronic control system 36 includes a processing device which may be configured to perform many functions, including interfacing 37, calculating 39, monitoring 41, controlling 43, and reporting 45 among others. The interfacing function 37 may include transceiving data from a touchpad or keyboard and a monitor or other display device to enable a technician or other user to enter or extract information. It may also include transmitting data to a printing device. In one embodiment, the interfacing function is performed with devices out of direct visual communication, remotely located, and may be electronically accessed over Ethernet, intranet, extranet, Internet, dial-up connection and wireless networks among others.

The calculation function 39 performed by the processing device may calculate the amount of refrigerant added/removed during a particular event. It may calculate the aggregate or percentage of addition/removal over a specified time period and/or calculate the projected use based on historical usage. It may also store the date and time of each refrigerant addition/removal, calculate the percentage of the total amount of refrigerant replaced over a specified period of time, and calculate a projection of refrigerant replacement based on recent service events and the initial total volume of the system.

The monitoring function 41 as performed by the processing device may monitor the pressure and temperature data and the height of refrigerant in the calibration container. Inputs from the pressure, temperature, and level measurement devices are received by the electronic control system 36 to be used by the calculating function 39 and the controlling function 43. The controlling function 43 as performed by the processing device may control the valves/switches for flow control responsive to measurement data received by the monitoring function 41 by sending signals to open or close the flow control devices.

The reporting function 45 as performed by the processing device may collect data from the monitoring function 41 and assimilate it. Assimilating the data may include storing it in a database for the calculating function or for dissemination by many means including, but not limited to, a printing device, a fixed disk drive, floppy drive, RAM, or other storage media. It may also include the function of sending the information by fax, email, or other electronic means. The data may be sent over many types of networks including, but not limited to, Ethernet, Internet, intranet, extranet, dial-up, and wireless.

The embodiments of the electronic control system 36 disclosed herein are not limited to each of the functions referred to, and the aspects that have been disclosed. One of ordinary skill in the art might be able to modify the electronic control system 36 for many other functions as well.

In reference to the elements of the measurement system which control the level/flow and any required parameters of refrigerant, they may include valves, switches, electromechanical switches, relays, solenoids, or other controllable devices as would be known to one skilled in the art. The descriptive terms for these elements are used interchangeably herein. The majority of the switches used in the preferred embodiment are selected to be closed when no power is supplied, prohibiting refrigerant flow. However, one skilled in the art might be able to configure the system using other types of switches as well.

Referring now to FIG. 2, the preferred embodiment of the refrigeration charging system 10 is shown. During a typical service or repair, when it is necessary to charge or replenish refrigerant into a specific refrigeration system 15, the refrigerant supply tank(s) 32 containing liquefied refrigerant under pressure greater than atmospheric pressure is connected to the input connection 42. The output connection 25 is also connected via a supply line 72 (most likely a flexible hose) to the refrigeration system's main liquid supply line at 73 typically equipped with charging valve 76. In a system with only one type of refrigerant, a single receiver 40 is generally located at the inlet to the system to act as an overflow reservoir. In addition, the output of the purge line 24 is connected to the suction manifold of the system 15 being filled, for example, by using connection hose 78.

It is common for a commercial refrigeration system (specifically in a supermarket) to consist of more than one refrigeration (compressor) rack. There may be, for example, low, medium, and high temperature applications in one site. In the preferred embodiment, a measured amount of refrigerant is transferred into a calibration container 20 and the amount transferred is monitored in a closed system such that the total transferred amount can be calculated. In an alternative embodiment, the calibration container 20 is replaced with a flow meter to measure the amount transferred. In one embodiment, the calibration container 20 is permanently connected to each compressor system in the refrigeration room. However, this may be cost and space prohibitive.

In the preferred embodiment, flexible pipes 72 and 78 are used to connect the calibration container 20 to the system 15 to be charged at that time. The embodiment using temporary connections has the advantage of allowing a reversal of the connection if the refrigerant needs to be removed from the system 15. The electronic control system 36 in this case is set to remove the refrigerant. The metering process is then performed with the connections reversed to transfer refrigerant to an approved reclaim container.

In this removal mode, the tank 32, now a reclamation tank specially designed for the acceptance of refrigerant, is connected to output connection 25 and flexible pipe 72 is connected with the refrigeration system liquid line 72 and at input connection 42. When the measurements are communicated to the central database, a removal is indicated instead of an addition. In this mode, the invention provides for rapid, convenient, and measured removal of refrigerant, a common practice during routine servicing of systems.

After a connection between a supply tank and the measurement system is established at connection 42, liquid supply valve 43 is manually opened, pressure device 44 detects the pressure of the refrigerant in the supply tank 32, thus confirming that the connection is completed. The electronic control system 36 is enabled at this time. The electronic control system 36 prompts for answers to some initial questions. Non-limiting examples include "What system are you putting refrigerant in?", "How much refrigerant do you want to put in?", and "What type of refrigerant are you putting in?" A start selection on the electronic control system 36 is selected and a charge cycle begins. In an alternative embodiment, there is no electronic control system 36, and the process can be undertaken by manually operating the valves/switches as disclosed herein.

The electronic control system 36 may identify the type of refrigerant in the tank 32 (for example, R-22, R507, etc.) by measuring the ambient temperature and the pressure in tank 32, or by other means. By identifying the refrigerant in tank 32, the electronic control system 36 may protect the system from being accidentally charged with an inappropriate refrigerant. The electronic control system 36 may also test the refrigerant in the system for purity and composition. This is important in systems that use blended refrigerants.

When the proper selections have been made, the following sequence occurs either automatically or manually, depending on whether the electronic control system 36 is used. In a supermarket, a mechanical equipment room may have more than one refrigeration system, and each system may have different refrigerants which cannot be mixed due to their varying thermodynamic properties. Therefore, it is important to have as clean a calibration receiver as possible before the charge of refrigerant is started. To assure the calibration container 20 is completely depleted of liquid refrigerant prior to beginning a new charge, a purge cycle is activated. The purge cycle is the process of removing residual refrigerant from the calibration container 20. It is necessary for two important reasons: (1) to clean the container 20 of residual refrigerant that may remain from the previous cycle, and (2) to provide an initial differential pressure between the supply tank 32 and the calibration container 20 to initiate the flow of refrigerant from the supply tank 32 to the container 20.

During the purge cycle the pressure in the container 20 becomes equal to the pressure in the suction manifold which is connected at the purge connection 24, in which case substantially all liquid refrigerant in container 20 evaporates. In the preferred embodiment, the electronic control system 36 opens purge valve 46, providing a connection between the top of container 20 through connection 22 and the suction manifold connection 24. Check valve 48 allows the refrigerant to flow out to the system 15 without allowing refrigerant in the system 15 back in the container 20. In one embodiment, a differential pressure device 34 is used to determine when all liquid refrigerant is removed from the calibration container 20. When the pressure differential reaches zero, the electronic control system 36 senses that the purge cycle is completed. In some embodiments, a time delay is added to continue the evacuation process after a zero reading to ensure the quality of the purge cycle.

In the preferred embodiment, the purge cycle is performed before and after every charge. However, one skilled in the art would understand that a purge cycle is not required every time. In an alternative embodiment, the calibration container connection 38 may be vented to the suction manifold as well, by opening valve 47 after the differential pressure read by differential pressure device 34 is measured to be zero. This is additional assurance that all liquid that may be remaining in container 20 is removed, preventing the mixing of refrigerants should multiple refrigerants be used in the same equipment room.

Once the purge cycle is complete, refrigerant supply valve 52 is opened. In the preferred embodiment, the liquid subcooler 56 is used in the line between liquid valve 52 and container 20. Liquid supply valve 54 and back pressure regulator 77 are opened allowing refrigerant liquid supplied from a permanent connection at connectors 51 and 55 from any operating system on the site to flow through subcooler 56, which, through evaporation, absorbs heat from the incoming liquid at connection 60. The temperature of the incoming refrigerant is reduced below the saturation temperature corresponding to the pressure in the tank. This creates a temperature differential between inlet connection 60 and outlet connection 62.

When the subcooled refrigerant from the subcooler 56 enters the calibration container 20 (which is still under low pressure achieved during the purging process), the pressure inside the container 20 corresponds to its temperature and, in turn, is below the pressure of the refrigerant in the supply tank 32. Therefore the constant differential pressure between the tank 32 and the container provides a transfer of refrigerant from the tank 32 to the container 20, causing efficient and quick flow.

Expansion valve 28 controls the flow of the liquid refrigerant from the subcooler input connection 55 through the subcooler 56 and to subcooler output connection 51. Back pressure regulator 77 is used in the suction line of the subcooler 56 to maintain constant evaporative pressure and to control the temperature of the subcooled refrigerant. Outlet check valve is used to prevent back flow of the refrigerant from the system 15 to the calibration container 20.

In one embodiment, shown in FIG. 2, the subcooler 56 is a coil of pipe 57 that is wrapped around the line 58 between the supply 32 and the calibration container 20. The subcooler 56 may be permanently connected during installation to one of the refrigeration systems. There are several different types of heat exchanges readily available in the marketplace which can be used as the subcooler such as tube-in-tube, brazed plate, and others. Alternatively, as shown in FIG. 3, a small self-contained compressor/condenser system 53 may be connected at the subcooler connections 55, 51. The self-contained system 53 permits the control of the subcooling of the refrigerant temperature independently from the operation of the system 15. This also results in easier installation due to the fact that the lines supplying the subcooler 56 are not permanently connected to a system at the site. Additionally, it reduces the number of field-installed connections and, therefore, the chances of developing leaks in those connections.

Figure 4:
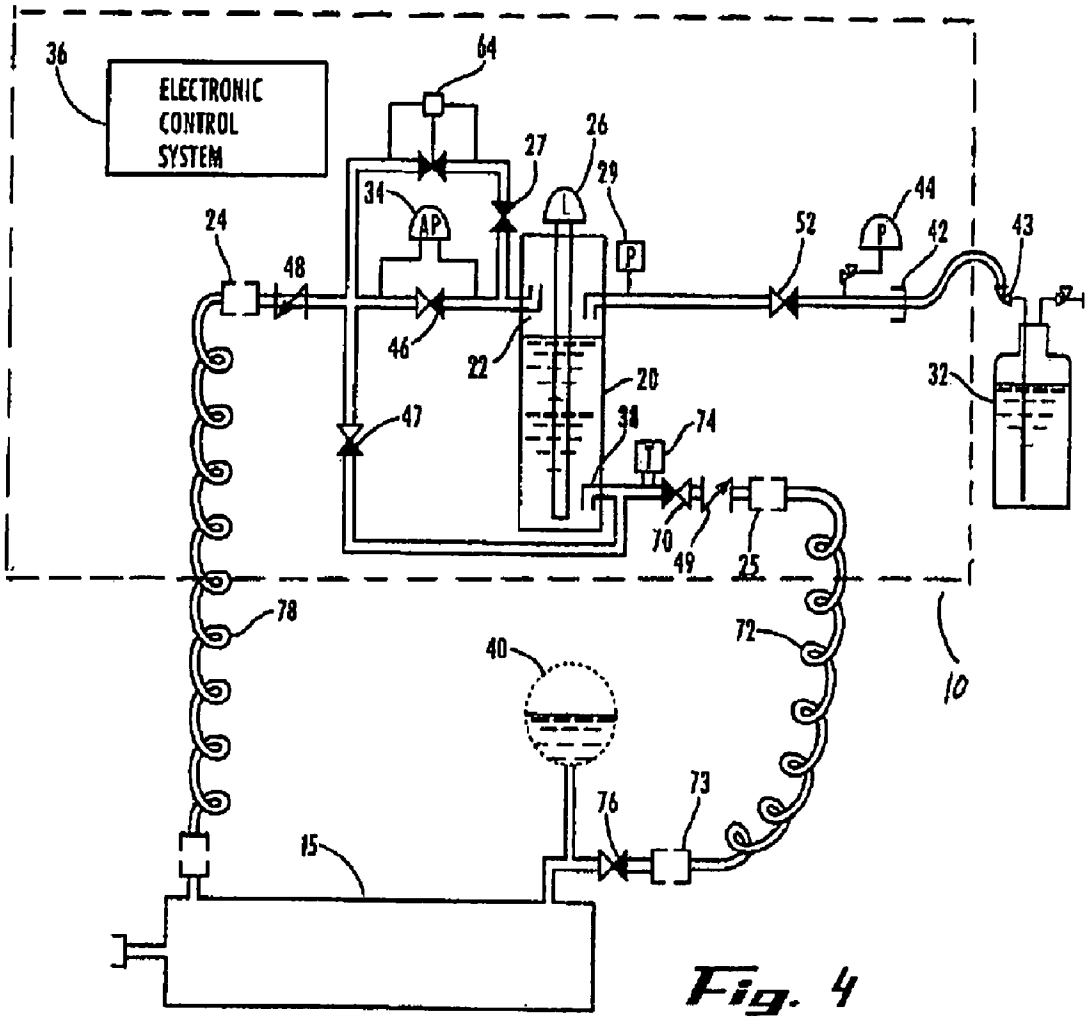
FIG. 4 is a diagram of the system of FIG. 2 with an alternative means for transferring refrigerant from a supply tank to a calibration container.
Figure 5:
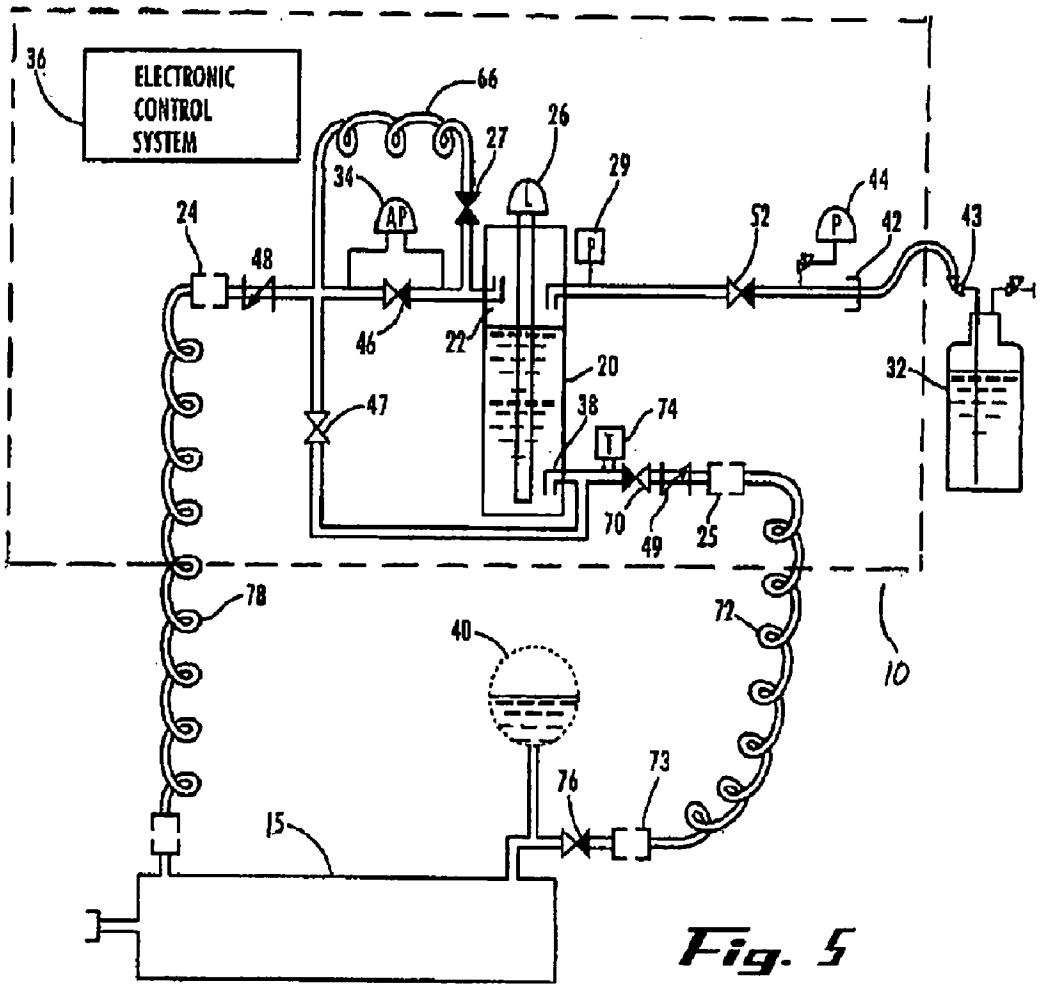
FIG. 5 is a diagram of the system of FIG. 2 with a second alternative means for transferring refrigerant from a supply tank to a calibration container.

In an alternative embodiment as shown in FIG. 4, a differential pressure regulator 64 between the calibration container 20 and the suction header connection 24 is used to create a differential pressure between the supply 32 and the calibration container 20, providing for refrigerant flow. Another embodiment, as shown in FIG. 5, uses a capillary tube 66 to create a constant pressure drop in the calibration container 20 that forces the refrigerant flow. In each of these embodiments, valve 27 is used to control the flow of refrigerant through the respective devices. However, the subcooler 56 in FIG. 2 is preferred because it provides for a controllable, predictable, pressure differential between tank 32 and calibration container 20 and eliminates leaks of refrigerant from container 20 to the suction header.

As the liquid refrigerant flows into the calibration container 20 in the preferred embodiment, it is measured using a capacitance-type liquid level transmitter 26. These transmitters are commonly available industrial devices, but one skilled in the art would know of other ways to measure the level of refrigerant in the calibration container 20.

In the preferred embodiment, control system 36 calculates the weight of the refrigerant utilizing factors including the temperature of the refrigerant measured by temperature sensor 74 on the bottom line of the container, to correct the density of the refrigerant which is stored in a database in the electronic control system, and the height of the liquid in the calibration container 20 measured by the liquid level transmitter 26. The level of the refrigerant in the calibration container 20 can be easily converted to the weight of the refrigerant using the following equation:

$$W=A*h*d$$

where

W=weight of the refrigerant in lbs

A=inside area of the calibration container 20 in $ft^2$ h=the height of the refrigerant inside the container in ft d=the density of refrigerant at a given temperature in $lb/ft^3$ Pressure sensor or transducer 29 at the top line of the container can be used to verify the saturated temperature of the refrigerant in the calibration container due to the predictable relationship between the pressure and temperature of a liquefied gas. When the weight of the refrigerant is equal to the desired amount entered into the control system 36 at the beginning of the charge, when the calibration container is measured to be 100% full, or when the supply tank is empty, valves 52, 54, and 77 (or valve 27 in another embodiment) close.

FIG. 2 further demonstrates one embodiment in which the refrigerant contained in calibration container 20 is then transferred to the refrigeration system 15 through the liquid line of the system 15 being charged. Valve 70 opens allowing the refrigerant in the calibration container 20 to be drawn into the system 15 by the operating compressors and flow of refrigerant through the system 15. Check valve 49 allows the refrigerant to flow out of the system 15 without allowing refrigerant in the system 15 back in the container 20. When the liquid level transmitter 26 that is measuring the level of refrigerant in the calibration container 20 reads zero, the initial transfer phase of the charge is completed and valve 70 is closed. Most of the residual refrigerant from the calibration container 20 has been moved into the refrigeration system 15 to be charged.

In this embodiment, the compressors of the system 15 draw the refrigerant out of the calibration container 20 and into the system 15. Although an alternative embodiment may involve pumping or mechanically forcing the refrigerant from the calibration container 20 into the system 15, it is not necessary to do so. The existing system 15 can be used.

In the preferred embodiment, if the charging of the system 15 is complete, the purge cycle described above is then repeated. If more refrigerant is desired than fits in the calibration container 20, the electronic control system 36 repeats the charging cycle until the total amount of requested refrigerant is added to the system. The iteration of the charging cycle is either done manually or automatically by the electronic control system 36. If the system 15 needs more than the capacity of the calibration container 20, the purge cycle may be skipped for these iterations, as blending of refrigerant is not a concern. However, any time a new charge is begun, a purge is preferable. Additionally, a large tank of refrigerant can be connected as the supply 32 such that when the electronic control system 36 is enabled, the transfer of refrigerant can immediately begin.

Figure 6:
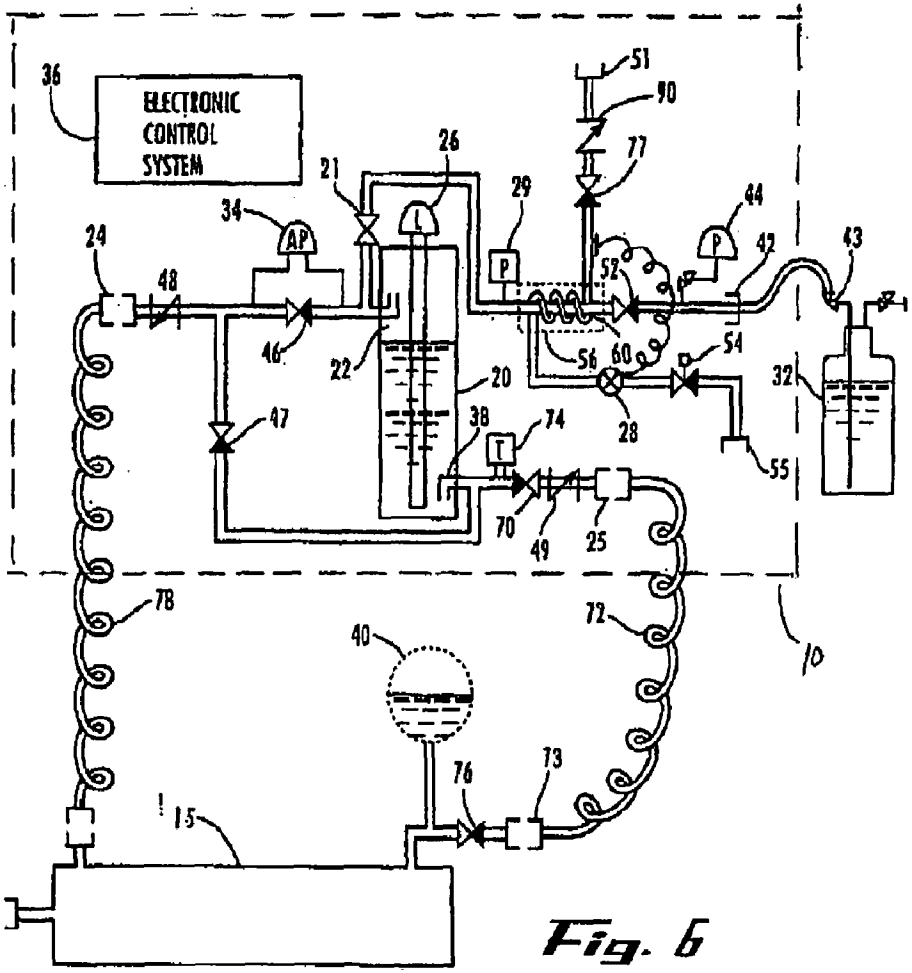
FIG. 6 is a diagram of the system in FIG. 2 with modified routing.
Figure 7:
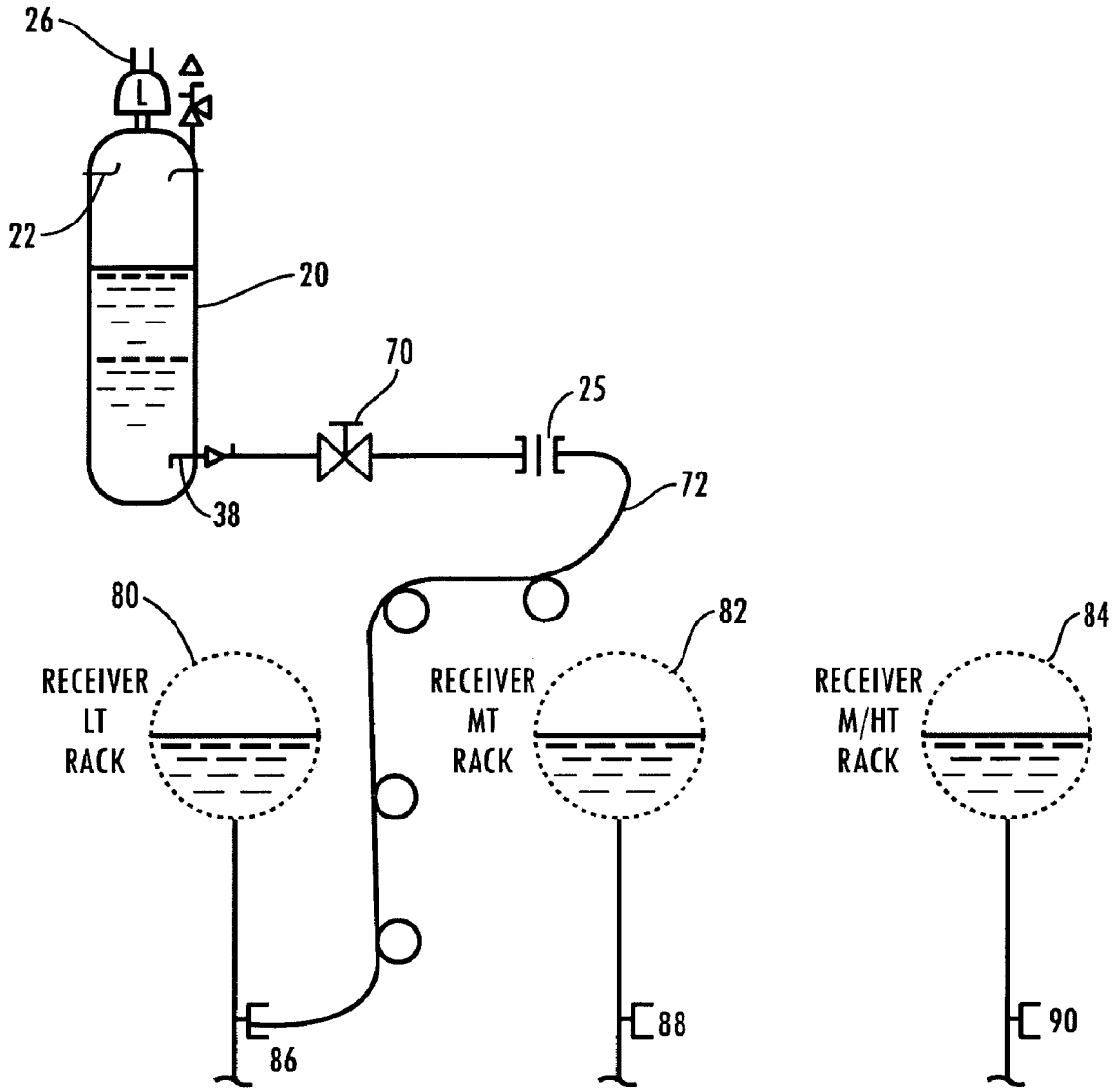

FIG. 6 provides an alternative embodiment with a modified routing scheme for the input line of the calibration container 20. In this embodiment, the output of the subcooler is connected to the connection 22 of the calibration container 20. This allows one less connection to the calibration container 20.

Figure 7:
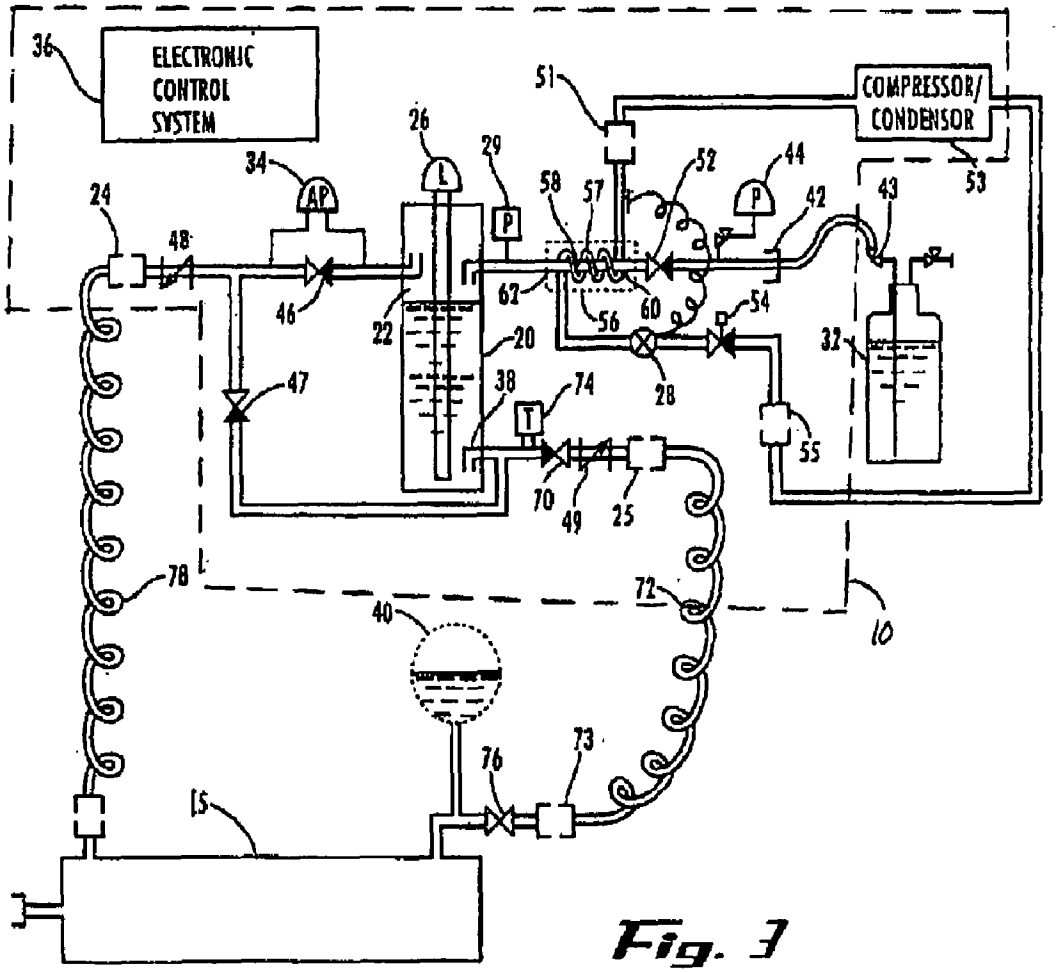
FIG. 7 is a diagram of the system of FIG. 2 providing connections to multiple refrigerant systems.

FIG. 7 provides an alternative embodiment, in which the calibration container 20 is connected with a flexible hose 72 to one of multiple receivers 80, 82, 84 with possibly varying refrigerant types. One or more receivers may hold refrigerant for a low temperature system, a medium temperature system, or a high temperature system, for example. Connection to the receiver is made at connector 86, 88, 90 respectively. All flexible hoses may be replaced with permanent pipe connections and separate feed valves so control system 36 can select the system to be charged based on operator input.

This disclosure has referred to the measurement of refrigerant. However, it would be obvious to one skilled in the art that the systems and methods disclosed hereinabove could be used with any other liquefied gases.

It should be emphasized that the above described embodiments of the present invention, particularly any preferred embodiment, are merely possible examples of implementations merely set forth for a clear understanding of the principles of the invention. Many variations and modifications may be made to the above described embodiments of the invention without departing substantially from the spirit and principles of the invention. All such modifications and variations are intended to be included herein within the scope of this disclosure and the present invention and protected by the following claims.

The invention claimed is:

1. A method for adding a measured quantity of refrigerant to a refrigeration system comprising the steps of:

purging refrigerant from a calibration container to a suction header of the refrigeration system;

transferring refrigerant from a liquefied gas supply to the calibration container to a desired level in the calibration container; and charging the refrigeration system with a measured quantity of the liquefied gas from said calibration container using differential pressure created by a change in thermodynamic properties of the refrigerant.

2. The method of claim 1, wherein the step of charging the refrigeration system with a measured quantity of refrigerant comprises transferring refrigerant at a pressure greater than atmospheric pressure.

3. The method of claim 1, wherein the step of purging the calibration container comprises equalizing the pressure of the calibration container with the pressure of a suction line of the system from the top of the calibration container.

4. The method of claim 1, wherein the step of purging refrigerant from the calibration container comprises moving the refrigerant through a connection at the bottom of the container.

5. The method of claim 1, wherein the step of purging the calibration container comprises moving the refrigerant from the calibration container through a suction line of the system at both the top and the bottom of the container.

6. The method of claim 1, wherein the step of transferring refrigerant from a refrigerant supply to the calibration container to a desired level in the calibration container comprises measuring the desired level of refrigerant with a liquid level transducer.

7. The method of claim 1, wherein the step of transferring refrigerant is performed by passing the refrigerant through a subcooler at a position between the refrigerant supply and the calibration container.

8. The method of claim 7, further including the step of refrigerating the subcooler through a connection to the refrigeration system.

9. The method of claim 7, further including the step of refrigerating the subcooler with a permanently connected, self-contained condensing unit.

10. The method of claim 1, wherein the step of transferring liquefied refrigerant is performed by utilizing an in-line differential pressure regulator located between the calibration container and the suction header.

11. The method of claim 1, wherein the step of transferring liquefied refrigerant is performed by utilizing an in-line capillary tube located between the calibration container and the suction header.

12. The method of claim 1, wherein the refrigerant is transferred without using a mechanical pumping device.

13. An apparatus for adding a measured level of refrigerant to a refrigeration system comprising:

a calibration container;

wherein the calibration container includes:

(a) a refrigerant level measuring means for the calibration container; and (b) connections for:

(1) receiving a supply of refrigerant;

(2) purging said calibration container to a suction header; and (3) charging a refrigeration system with refrigerant from the calibration container using differential pressure created by a change in thermodynamic properties of the refrigerant.

14. The apparatus of claim 13, wherein the refrigerant measuring means is a level transducer.

15. The apparatus of claim 13, wherein the connections are connected through valves.

16. The apparatus of claim 13, wherein the connections are connected through electro/mechanical switches.

17. The apparatus of claim 13, wherein the connections are connected through solenoid switches.

18. The apparatus of claim 13, further comprising a subcooler connected between the calibration container and the supply of refrigerant.

19. The apparatus of claim 18, wherein the subcooler is refrigerated through a connection to the refrigeration system.

20. The apparatus of claim 18, wherein the subcooler is refrigerated by a permanently connected, self-contained condensing unit.

21. The apparatus of claim 13, further comprising a differential pressure regulator located between the calibration container and the suction header.

22. The apparatus of claim 13, further comprising a capillary tube located between the calibration container and the suction header.

23. The method of claim 13, wherein the refrigerant is transferred without using a mechanical pumping device.

* * * * *